US012716239B2

(12) United States Patent
Chin

(10) Patent No.: US 12,716,239 B2
(45) Date of Patent: Aug. 25, 2026

(54) ROOFING MEMBRANE WITH SELVAGE EDGES AND ASSOCIATED METHOD AND ARTICLE

(71) Applicant: BMIC LLC, Dallas, TX (US)

(72) Inventor: Norman Chin, Somerville, NJ (US)

(73) Assignee: BMIC LLC, Dallas, TX (US)

( * ) Notice: Subject to any disclaimer, the term of this patent is extended or adjusted under 35 U.S.C. 154(b) by 435 days.

(21) Appl. No.: 18/364,531

(22) Filed: Aug. 3, 2023

(65) Prior Publication Data

US 2024/0044139 A1 Feb. 8, 2024

Related U.S. Application Data

(60) Provisional application No. 63/370,521, filed on Aug. 5, 2022.

(51) Int. Cl.
*E04D 5/10* (2006.01)
*E04D 5/14* (2006.01)

(52) U.S. Cl.
CPC ..... *E04D 5/10* (2013.01); *E04D 5/148* (2013.01)

(58) Field of Classification Search
CPC .. E04D 5/06; E04D 5/10; E04D 5/148; E04D 5/149
See application file for complete search history.

(56) References Cited

U.S. PATENT DOCUMENTS 5,260,111 A * 11/1993 Valaitis ..... B29C 66/91411 428/521
6,701,685 B2 3/2004 Rippey
10,751,978 B2 * 8/2020 Murillo-Maese ..... B32B 7/12
2002/0170254 A1 11/2002 Ritland
2005/0126103 A1 6/2005 Scheirer
2006/0035048 A1 2/2006 Swann
2006/0127627 A1 6/2006 Larson
(Continued)

FOREIGN PATENT DOCUMENTS

EP 0352394 B1 2/1992
GB 1106342 A * 3/1968 ..... E04D 5/10

OTHER PUBLICATIONS

International Search Report and Written Opinion dated Sep. 26, 2023, in corresponding PCT/US2023/029405 (9 pages) (mailed Oct. 30, 2023).

*Primary Examiner* — Christine T Cajilig
(74) *Attorney, Agent, or Firm* — Venable LLP

(57) ABSTRACT

A roofing system comprises a roof deck and first and second membranes, each comprising a sheet having a top surface and a bottom surface opposite the top surface, the bottom surface having a first edge portion, a second edge portion opposite the first edge portion, a third edge portion extending between the first and second edge portions, a fourth edge portion opposite the third edge portion and extending between the first and second edge portions, and a middle portion disposed apart from the first, second, third, and fourth edge portions. The roofing system further includes an adhesive disposed on the middle portion of the bottom surfaces, and at least three edge portions of the bottom surfaces are free of adhesive. The adhesives adhere the first and second membranes to the roof deck, and at least one edge portion free of adhesive overlaps another edge portion, with the overlapping edge portions being welded to one another.

20 Claims, 3 Drawing Sheets

(56) References Cited

U.S. PATENT DOCUMENTS

| | | | | |
|---|---|---|---|---|
| 2015/0176281 | A1 | 6/2015 | Yang | |
| 2016/0325539 | A1 | 11/2016 | Murillo-Maese | |
| 2019/0119910 | A1* | 4/2019 | Yokochi | B32B 37/1292 |
| 2020/0171805 | A1* | 6/2020 | Ledford | B32B 7/06 |
| 2020/0299966 | A1* | 9/2020 | Tang | E04D 5/08 |
| 2021/0189186 | A1 | 6/2021 | Schoenbrodt et al. | |
| 2021/0309891 | A1* | 10/2021 | Schoenbrodt | E04B 1/665 |
| 2022/0098865 | A1 | 3/2022 | Rufus | |
| 2022/0403658 | A1* | 12/2022 | Taylor | E04D 5/06 |
| 2023/0358046 | A1* | 11/2023 | Duhamel | B32B 5/024 |
| 2024/0417598 | A1* | 12/2024 | Haufe | C09J 7/241 |
| 2025/0067050 | A1* | 2/2025 | Svec | E04D 1/2918 |

* cited by examiner

ROOFING MEMBRANE WITH SELVAGE EDGES AND ASSOCIATED METHOD AND ARTICLE

This application claims the priority of U.S. provisional application Ser. No. 63/370,521 entitled "Roofing Membrane With Selvage Edges And Associated Method and Article" filed Aug. 5, 2022, which is incorporated herein by reference in its entirety for all purposes.

FIELD

The disclosure relates to a roofing membrane with selvage edges, and an associated method of installing the roofing membrane.

BACKGROUND

A roofing membrane has an adhesive on a bottom surface, so that the roofing membrane may be installed by adhering the roofing membrane to a roof deck. The top and bottom edge portions of the bottom surface are selvage edges that are free of the adhesive, however. This allows the formation of a weld between overlapping top and bottom edges of two roofing membranes adhered to the roof deck adjacent to one another, when multiple roofing membranes are used to cover the roof deck. That is, the weld is formed between the edge portions that are free of the adhesive. The roofing membrane has only two selvage edges that are free of the adhesive because, during manufacture of the roofing membrane, the adhesive is sprayed on the bottom surface along an entire length of the roofing membrane, from one end of the roofing membrane to the other end.

SUMMARY

Covered embodiments are defined by the claims, not this summary. This summary is a high-level overview of various aspects and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

In some embodiments, a roofing system comprises: a roof deck; a first membrane comprising: a first sheet having: a first top surface, and a first bottom surface opposite the first top surface, the first bottom surface having a first edge portion, a second edge portion opposite the first edge portion, a third edge portion extending between the first and second edge portions, a fourth edge portion opposite the third edge portion and extending between the first and second edge portions, and a middle portion disposed apart from the first, second, third, and fourth edge portions; a first adhesive, the first adhesive disposed on the middle portion of the first bottom surface, and at least the first, second, and fourth edge portions of the first bottom surface are free of adhesive; a second membrane comprising: a second sheet having: a second top surface, and a second bottom surface opposite the second top surface, the second bottom surface having a first edge portion, a second edge portion opposite the first edge portion, a third edge portion extending between the first and second edge portions, a fourth edge portion opposite the third edge portion and extending between the first and second edge portions, and a middle portion disposed apart from the first, second, third, and fourth edge portions; a second adhesive, the second adhesive disposed on the middle portion of the second bottom surface, and at least the first, second, and third edge portions of the second bottom surface are free of adhesive, wherein the first adhesive adheres the first membrane to the roof deck, wherein the second adhesive adheres the second membrane to roof deck, wherein the fourth edge portion of the first membrane and the third edge portion of the second membrane overlap one another, and wherein the fourth edge portion of the first membrane and the third edge portion of the second membrane are welded to one another.

In some embodiments, the first edge portion of the first membrane extends in a first direction, the first edge portion of the second membrane extends in the first direction, and the first membrane is adjacent the second membrane.

In some embodiments, the first adhesive does not contact the second membrane, and the second adhesive does not contact the first membrane.

In some embodiments, each of the first, second, third, and fourth edge portions of the first bottom surface are free of adhesive.

In some embodiments, each of the first, second, third, and fourth edge portions of the second bottom surface are free of adhesive.

In some embodiments, a width of at least one of the edge portions that is free of adhesive is from 2 to 6 inches.

In some embodiments, at least one of the first membrane or the second membrane is from 50 to 100 feet in length and from 5 to 15 feet in width.

In some embodiments, a method comprises: obtaining a first membrane comprising: a first sheet having: a first top surface, and a first bottom surface opposite the first top surface, the first bottom surface having a first edge portion, a second edge portion opposite the first edge portion, a third edge portion extending between the first and second edge portions, a fourth edge portion opposite the third edge portion and extending between the first and second edge portions, and a middle portion disposed apart from the first, second, third, and fourth edge portions; a first adhesive, the first adhesive on the middle portion of the first bottom surface, and at least the first, second, and fourth edge portions of the first bottom surface are free of adhesive; a first removable liner, the first removable liner covering the first adhesive; removing the first removable liner from the first adhesive, thereby to expose the first adhesive, contacting the first adhesive of the first membrane to a roof deck, thereby to adhere the first membrane to the roof deck; obtaining a second membrane comprising: a second sheet having: a second top surface, and a second bottom surface opposite the second top surface, the second bottom surface having a first edge portion, a second edge portion opposite the first edge portion, a third edge portion extending between the first and second edge portions, a fourth edge portion opposite the third edge portion and extending between the first and second edge portions, and a middle portion disposed apart from the first, second, third, and fourth edge portions; a second adhesive, the second adhesive on the middle portion of the second bottom surface, and at least the first, second, and third edge portions of the second bottom surface are free of adhesive; a second removable liner, the second removable liner covering the second adhesive; removing the second removable liner from the second adhesive, thereby to expose the second adhesive; contacting the second adhesive of the second membrane to the roof deck, thereby to adhere the second membrane to the roof deck, wherein the third edge portion of the second membrane and the fourth edge portion of the first membrane overlap one another; and welding the third edge portion of the second membrane and the fourth edge portion of the first membrane together.

In some embodiments, the first edge portion of the first membrane extends in a first direction, the first edge portion of the second membrane extends in the first direction, and the first membrane is adjacent the second membrane.

In some embodiments, the first adhesive does not contact the second membrane, and the second adhesive does not contact the first membrane.

In some embodiments, each of the first, second, third, and fourth edge portions of the first bottom surface are free of adhesive.

In some embodiments, each of the first, second, third, and fourth edge portions of the second bottom surface are free of adhesive.

In some embodiments, the method further comprises: obtaining a third membrane comprising: a third sheet having: a third top surface, and a third bottom surface opposite the third top surface, the third bottom surface having a first edge portion, a second edge portion opposite the first edge portion, a third edge portion extending between the first and second edge portions, a fourth edge portion opposite the third edge portion and extending between the first and second edge portions, and a middle portion disposed apart from the first, second, third, and fourth edge portions; a third adhesive, the third adhesive on the middle portion of the third bottom surface, and at least the first edge portion of the third bottom surface is free of adhesive; a third removable liner, the third removable liner covering the third adhesive; removing the third removable liner from the third adhesive, thereby to expose the third adhesive; contacting the third adhesive of the third membrane to the roof deck, thereby to adhere the third membrane to the roof deck, wherein the first edge portion of the third membrane and the second edge portion of the first membrane overlap one another; and welding the first edge portion of the third membrane and the second edge portion of the first membrane together.

In some embodiments, at least three of the edge portions of the third bottom surface are free of adhesive.

In some embodiments, an article comprises: a roofing membrane roll, comprising: a longitudinal axis; and a sheet having: a top surface, and a bottom surface opposite the top surface, the bottom surface having a first edge portion, a second edge portion opposite the first edge portion, a third edge portion extending between the first and second edge portions, a fourth edge portion opposite the third edge portion and extending between the first and second edge portions, and a middle portion disposed apart from the first, second, third, and fourth edge portions, wherein the first and second edge portions extend along an entire length of the sheet in a direction perpendicular to the longitudinal axis of the roofing membrane roll; an adhesive, the adhesive on the middle portion of the bottom surface, and at least three of the first, second, third, and fourth edge portions of the bottom surface are free of adhesive, and a removable liner, the removable liner covering the adhesive, wherein the adhesive is configured to attach the roofing membrane roll to a roof deck after removal of the liner.

In some embodiments, each of the first, second, third, and fourth edge portions of the bottom surface are free of adhesive, and the adhesive is only on the middle portion of the bottom surface.

BRIEF DESCRIPTION OF THE DRAWINGS

Reference is made to the drawings that form a part of this disclosure, and which illustrate embodiments in which the materials and methods described herein can be practiced.

DETAILED DESCRIPTION

Figure 1:
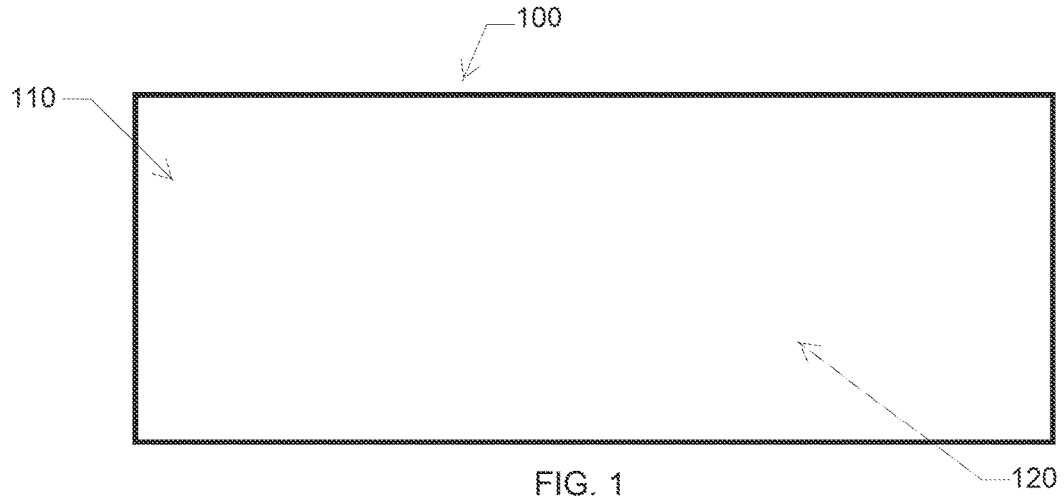
FIG. 1 is a top view of a roofing membrane, in accordance with an embodiment of the invention.

Among those benefits and improvements that have been disclosed, other objects and advantages of this disclosure will become apparent from the following description taken in conjunction with the accompanying figures. Detailed embodiments of the present disclosure are disclosed herein; however, the disclosed embodiments are merely illustrative of the disclosure that may be embodied in various forms. In addition, each of the examples given regarding the various embodiments of the disclosure which are intended to be illustrative, and not restrictive.

Throughout the specification and claims, the following terms take the meanings explicitly associated herein, unless the context clearly dictates otherwise. The phrases "in an embodiment," "in some embodiments," and any similar phrase, as used herein, do not necessarily refer to the same embodiment or embodiments, though the phrases may refer to the same embodiment or embodiments. Furthermore, the phrases "in another embodiment," and any similar phrase, as used herein, do not necessarily refer to a different embodiment, although the phrases may refer to a different embodiment. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, terms such as "comprising" "including," "having," and any similar phrase, do not limit the scope of a specific claim to the materials or steps recited by the claim.

As used herein, terms such as "consisting of" limit the scope of a specific claim to the materials and steps recited by the claim.

In some embodiments, the disclosure is directed to a roofing membrane including a top surface, a bottom surface opposite the top surface, and an adhesive disposed on the bottom surface, where the adhesive covers at least the middle portion of the bottom surface, while at least three of the edge portions of the bottom surface are free of the adhesive, such that the roofing membrane may be connected (that is, adhered) to a roof deck by the adhesive.

In some embodiments, the disclosure is directed to a roofing membrane including a top surface, a bottom surface opposite the top surface, and an adhesive disposed on only the bottom surface, where the adhesive covers only least the middle portion of the bottom surface, while four of the edge portions of the bottom surface are free of the adhesive.

In some embodiments, the width of one or more of the edge portions that are free of the adhesive may be 6 inches. In some embodiments, the width of one or more of the edge portions that are free of the adhesive may be 2 inches. In some embodiments, the width of one or more of the edge portions that are free of the adhesive may be 3 inches. In some embodiments, the width of one or more of the edge portions that are free of the adhesive may be 4 inches. In some embodiments, the width of one or more of the edge portions that are free of the adhesive may be 5 inches. In some embodiments, the width of one or more of the edge portions that are free of the adhesive may be 2 to 6 inches. In some embodiments, the width of one or more of the edge portions that are free of the adhesive may be 2 to 3 inches. In some embodiments, the width of one or more of the edge portions that are free of the adhesive may be 2 to 4 inches. In some embodiments, the width of one or more of the edge portions that are free of the adhesive may be 2 to 5 inches. In some embodiments, the width of one or more of the edge portions that are free of the adhesive may be 3 to 4 inches. In some embodiments, the width of one or more of the edge portions that are free of the adhesive may be 3 to 5 inches. In some embodiments, the width of one or more of the edge portions that are free of the adhesive may be 3 to 6 inches. In some embodiments, the width of one or more of the edge portions that are free of the adhesive may be 4 to 5 inches. In some embodiments, the width of one or more of the edge portions that are free of the adhesive may be 4 to 6 inches. In some embodiments, the width of one or more of the edge portions that are free of the adhesive may be 5 to 6 inches.

In some embodiments, the one or more edge portions that are free of the adhesive may be configured to overlap and form a weld with one or more edge portions of another roofing membrane which are free of the adhesive.

In some embodiments, the roofing membrane may be supplied in the form of a sheet.

In some embodiments, the roofing membrane may be supplied in the form of a roll, such that the roofing membrane is in the form of a rolled-up roofing membrane.

In some embodiments, the rolled-up roofing membrane may be rolled around a center roll that is separate from roofing membrane. In some embodiments, the rolled-up roofing membrane may be rolled around a cardboard center roll. In some embodiments, the rolled-up roofing membrane may be rolled around a center roll formed of another material. In some embodiments, the rolled-up roofing membrane may not be rolled around a separate center roll.

In some embodiments, the material of the roofing membrane may be one or more of: thermoplastic polyolefin (TPO); polyvinyl chloride (PVC); Styrene-Butadien-Styrene (SBS) modified bitumen; polymethylmethacrylate (PMMA); ethylene propylene diene monomer (EPDM); modified bitumen (MODBIT); a styrenic block copolymer; a polyolefin; a thermoplastic vulcanizate (TPV); a thermoplastic elastomer (TPE) (e.g., a thermoplastic elastomer blend); a polymeric material; and combinations of one or more of the above. In some embodiments, the polymeric material may be one or more of: polyvinyl chlorides (PVC); cyclopiazonic acid (CPA); chlorinated polyethylene resins (CPE); ethylene interpolymers (EIP); nitrile butadiene polymers (NBP); polyisobutylenes (PIB); atactic-polypropylene (APP); APP-modified bitumen; poly(styrene-butadiene-styrene) (SBS); styrene ethylene butylene styrene (SEBS); chlorosulfonated polyethylene rubbers (CSPE); polychloroprene (CR); extracellular region membranes (ECR); polycarbonate; nylon; polyvinyl acetate; polystyrene; polytetrafluoroethylene; polyvinylidene fluoride (PVDF); polyurethane; and combinations of one or more of the above. In some embodiments, the material of he roofing membrane may be a heat weldable material. In some embodiments, the material of the roofing membrane may be any combination of the above materials.

In some embodiments, the adhesive layer comprises, consists of, or consists essentially of at least one of an epoxy adhesive, a polyurethane adhesive, an acrylic adhesive, an ultraviolet radiation cured adhesive, a silicone-containing adhesive, a silyl modified polymer, a silane terminated polymer, natural rubber, a polyolefin polymer, a poly-alpha-olefin (APAO/APO) polymer, a polyamide polyvinyl acetate, a poly vinyl acetate, a polyvinyl alcohol, an ethylene vinyl acetate, a polyamide, a polyester, a polyester amide, an ethylene acrylic, a butyl rubber, or any combination thereof.

In some embodiments, the adhesive layer has a thickness of 4 mil to 15 mil. In some embodiments, the adhesive layer has a thickness of 5 mil to 15 mil. In some embodiments, the adhesive layer has a thickness of 6 mil to 15 mil. In some embodiments, the adhesive layer has a thickness of 7 mil to 15 mil. In some embodiments, the adhesive layer has a thickness of 8 mil to 15 mil. In some embodiments, the adhesive layer has a thickness of 9 mil to 15 mil. In some embodiments, the adhesive layer has a thickness of 10 mil to 15 mil. In some embodiments, the adhesive layer has a thickness of 11 mil to 15 mil. In some embodiments, the adhesive layer has a thickness of 12 mil to 15 mil. In some embodiments, the adhesive layer has a thickness of 13 mil to 15 mil. In some embodiments, the adhesive layer has a thickness of 4 mil to 14 mil. In some embodiments, the adhesive layer has a thickness of 4 mil to 13 mil. In some embodiments, the adhesive layer has a thickness of 4 mil to 12 mil. In some embodiments, the adhesive layer has a thickness of 4 mil to 11 mil. In some embodiments, the adhesive layer has a thickness of 4 mil to 10 mil. In some embodiments, the adhesive layer has a thickness of 4 mil to 9 mil. In some embodiments, the adhesive layer has a thickness of 4 mil to 8 mil. In some embodiments, the adhesive layer has a thickness of 4 mil to 7 mil. In some embodiments, the adhesive layer has a thickness of 4 mil to 6 mil. In some embodiments, the roofing membrane may include a removable liner covering the adhesive, the removable liner configured to be removed to expose the adhesive, such that the roofing membrane may be connected (that is, adhered) to a roof deck by the adhesive.

In some embodiments, the liner may cover at least a portion of the adhesive. In some embodiments, the liner may cover the entirety of the adhesive. In some embodiments, the liner may cover one or more edge portions that are free of the adhesive. In some embodiments, the liner may cover all of the edge portions, whether or not the edge portions are free of the adhesive. In some embodiments, the liner may be configured to be attached to and removed from the adhesive without affecting the adhesive properties of the adhesive.

In some embodiments, the roofing membrane may be 50 feet in the longest dimension (that is, 50 feet in length). In some embodiments, the roofing membrane may be 100 feet in length.

In some embodiments, the roofing membrane may be 5 feet in the next longest direction (that is, 5 feet in width). In some embodiments, the roofing membrane may be 10 feet in width. In some embodiments, the roofing membrane may be 12 feet in width. In some embodiments, the roofing membrane may be 15 feet in width. In some embodiments, the roofing membrane may be from 5 to 15 feet in width. In some embodiments, the roofing membrane may be from 5 to 10 feet in width. In some embodiments, the roofing membrane may be from 5 to 12 feet in width. In some embodiments, the roofing membrane may be from 10 to 12 feet in width. In some embodiments, the roofing membrane may be from 10 to 15 feet in width. In some embodiments, the roofing membrane may be from 12 to 15 feet in width.

In some embodiments, the roofing membrane has a thickness of 40 mil to 100 mil. In some embodiments, the roofing membrane has a thickness of 45 mil to 100 mil. In some embodiments, the roofing membrane has a thickness of 50 mil to 100 mil. In some embodiments, the roofing membrane has a thickness of 55 mil to 100 mil. In some embodiments, the roofing membrane has a thickness of 60 mil to 100 mil. In some embodiments, the roofing membrane has a thickness of 65 mil to 100 mil. In some embodiments, the roofing membrane has a thickness of 70 mil to 100 mil. In some embodiments, the roofing membrane has a thickness of 75 mil to 100 mil. In some embodiments, the roofing membrane has a thickness of 80 mil to 100 mil. In some embodiments, the roofing membrane has a thickness of 85 mil to 100 mil. In some embodiments, the roofing membrane has a thickness of 90 mil to 100 mil. In some embodiments, the roofing membrane has a thickness of 40 mil to 90 mil. In some embodiments, the roofing membrane has a thickness of 40 mil to 85 mil. In some embodiments, the roofing membrane has a thickness of 40 mil to 80 mil. In some embodiments, the roofing membrane has a thickness of 40 mil to 75 mil. In some embodiments, the roofing membrane has a thickness of 40 mil to 70 mil. In some embodiments, the roofing membrane has a thickness of 40 mil to 65 mil. In some embodiments, the roofing membrane has a thickness of 40 mil to 60 mil. In some embodiments, the roofing membrane has a thickness of 40 mil to 55 mil. In some embodiments, the roofing membrane has a thickness of 40 mil to 50 mil.

In some embodiments, when more than one roofing membrane is used to cover a roof deck, the roofing membranes may be the same as one another. In some embodiments, when more than one roofing membrane is used to cover a roof deck, the roofing membranes may be the different than one another.

In some embodiments, overlapping edges of adjacent roofing membranes which are free of the adhesive are welded to one another.

Figure 2:
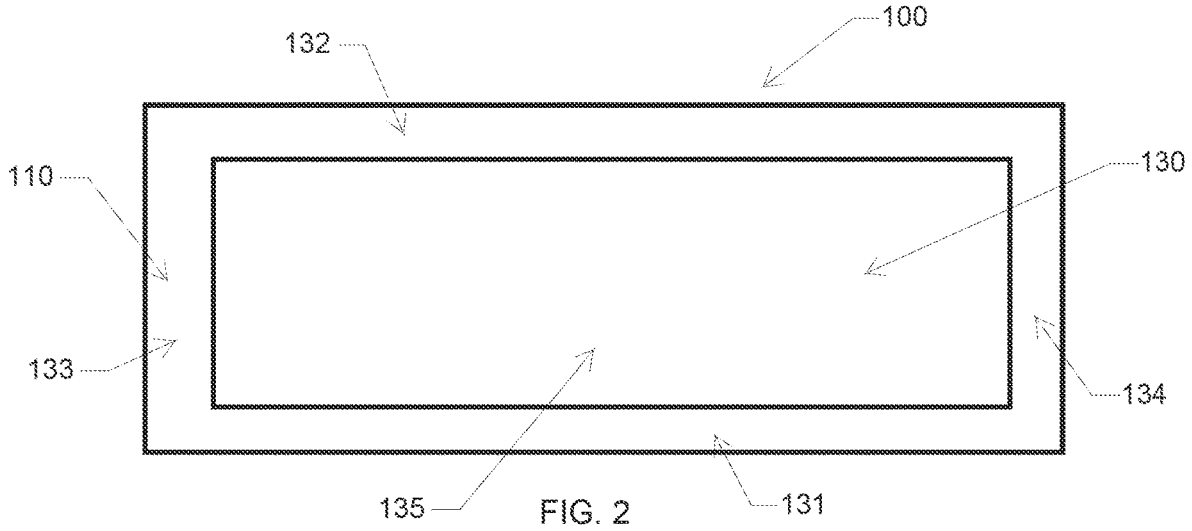
FIG. 2 is a bottom view of the roofing membrane of FIG. 1.

With reference to the figures, FIG. 1 illustrates a top view of an embodiment of roofing membrane 100, and FIG. 2 illustrates a bottom view of the embodiment of roofing membrane 100 of FIG. 1. The figures show roofing membrane spread out flat. As discussed above, in some embodiments, roofing membrane 100 may be supplied in the form of a sheet. Also as discussed above, in another embodiment, roofing membrane 100 may be supplied in the form of a roll (that is, in the form of a rolled-up roofing membrane, or a roofing membrane roll).

As shown in FIGS. 1 and 2, roofing membrane 100 may include sheet 110. Sheet 110 may have a top surface 120, and a bottom surface 130. Bottom surface 130 may be opposite to top surface 120. Bottom surface 130 may have first edge portion 131, second edge portion 132 opposite first edge portion 131, third edge portion 133 extending between first edge portion 131 and second edge portion 132, and fourth edge portion 134 opposite third edge portion 133 and extending between first edge portion 131 and second edge portion 132. Bottom surface 130 may include middle portion 135 disposed apart from first edge portion 131, second edge portion 132, third edge portion 133, and fourth edge portion 134. When roofing membrane 100 is supplied in the form of a roll, each of first edge portion 131 and second edge portion 132 may extend along an entire length of sheet 110 in a direction perpendicular to a longitudinal axis of rolled-up roofing membrane 100. Restated, when roofing membrane 100 is in the form of a roll, the longitudinal axis may be parallel to each of third edge portion 133 and fourth edge portion 134, and perpendicular to each of first edge portion 131 and second edge portion 132.

Roofing membrane 100 may include an adhesive. The adhesive may be configured to attach (that is, to adhere) roofing membrane 100 to a roof deck (as discussed below). In some embodiments, the adhesive may be on middle portion 135 of bottom surface 130. In some embodiments, each of the four edge portions—first edge portion 131, second edge portion 132, third edge portion 133, and fourth edge portion 134—may be free of adhesive, so that only middle portion 135 of bottom surface 130 may include the adhesive.

Roofing membrane 100 may include a removable liner. In some embodiments, the removable liner may cover the adhesive on bottom surface 130. In some embodiments, the removable liner may cover any or all of first edge portion 131, second edge portion 132, third edge portion 133, and fourth edge portion 134, regardless of whether any particular edge portion does or does not include the adhesive. The adhesive may be configured to attach (that is, to adhere) roofing membrane 100 to a roof deck (as discussed below).

Figure 3:
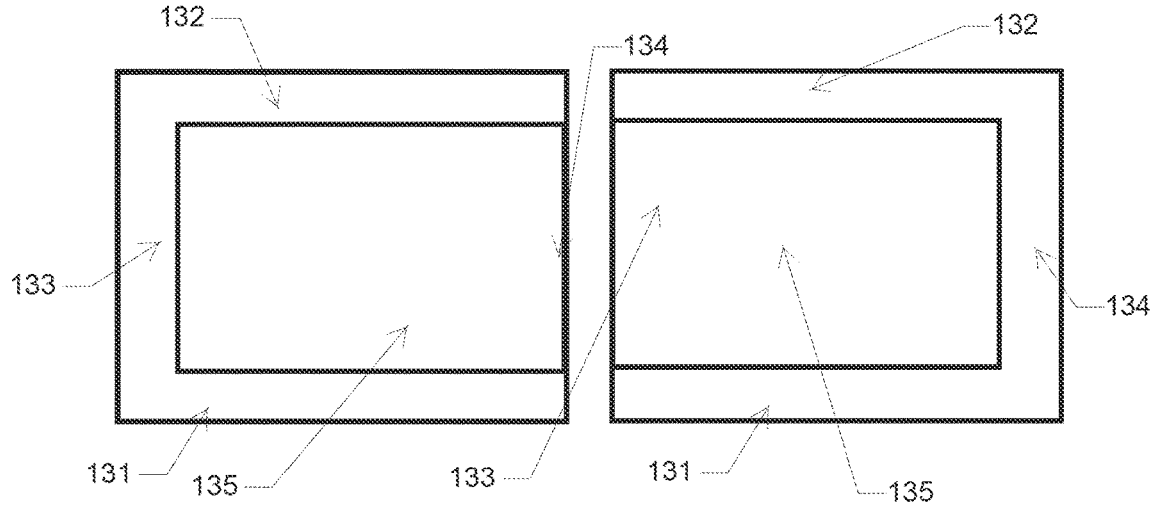
FIG. 3 is a top view of two roofing membranes, in accordance with an embodiment of the invention.

With reference to FIG. 3, which is a bottom view, when a roofing membrane that includes four edge portions that are free of the adhesive is cut into two pieces, such that two roofing membranes 100 are formed, both roofing membrane 100 may have at least three edge portions free of adhesive, and the adhesive may be on middle portion 135 and one edge portion of each roofing membrane 100. That is, throughout this disclosure, each separate roofing membrane (i.e., each piece of roofing membrane) is referred to as a roofing membrane, regardless of whether the pieces are cut from the same, larger roofing membrane. The roofing membranes 100 shown in FIG. 3 may be formed by cutting roofing membrane 100 of FIGS. 1 and 2 into two pieces, by a cut that extends parallel to each of third edge portion 133 and fourth edge portion 134, and perpendicular to each of first edge portion 131 and second edge portion 132 of roofing membrane 100 from FIGS. 1 and 2.

Returning to FIG. 3, in the leftmost roofing membrane 100, first edge portion 131, second edge portion 132, and third edge portion 133 may be free of the adhesive, so that middle portion 135 and fourth edge portion 134 of bottom surface 130 may include the adhesive. In the rightmost roofing membrane 100, first edge portion 131, second edge portion 132, and fourth edge portion 134 may be free of the adhesive, so that middle portion 135 and third edge portion 133 of bottom surface 130 may include the adhesive.

Figure 4:
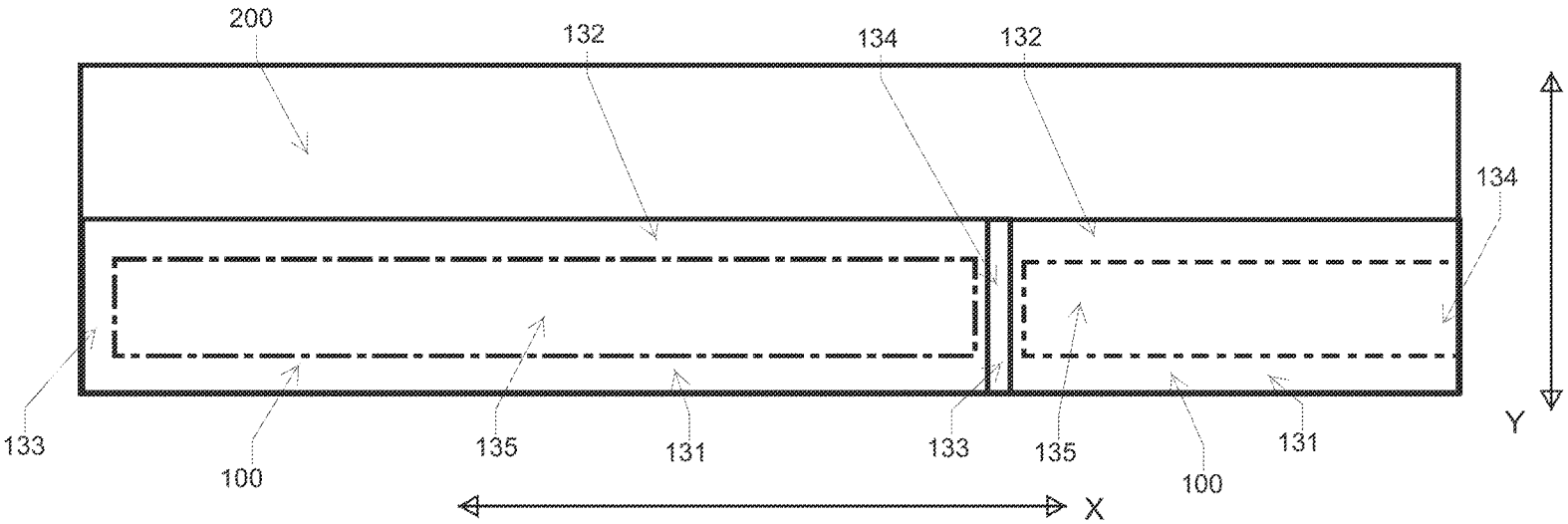
FIG. 4 is a top view of two roofing membranes installed on a roof deck, in accordance with an embodiment of the invention.

FIG. 4 shows a top view of two roofing membranes 100 attached or adhered to roof deck 200. Because FIG. 4 shows a top view, the adhesive, which is on the bottom of each roofing membrane 100, is shown in dotted lines. Also, because FIG. 4 shows top surfaces of roofing membranes 100, while FIGS. 2 and 3 discussed above show bottom surfaces of roofing membranes 100, the left edge portion in FIG. 4 corresponds to the right edge portion of FIGS. 2 and 3; and the right edge portion of FIG. 4 corresponds to the left edge portions of FIGS. 2 and 3. Nonetheless, when describing the embodiments shown in the figures, the leftmost edge portion is described as the third edge portion, while the rightmost edge portion is described as the fourth edge portion.

Returning to FIG. 4, FIG. 4 shows an embodiment including one roofing membrane 100, with four edges free of the adhesive (that is, the adhesive is disposed on only middle portion 135); and one roofing membrane 100 (resulting, for example, from cutting roofing membrane 100 of FIGS. 1 and 2), with three edges free of the adhesive (that is, with the adhesive disposed on middle portion 135 and one edge portion). The roofing membranes are disposed adjacent to one another, the length of each roofing membrane extending in a first direction "X," and the width of each roofing membrane extending in a second direction "Y" that is perpendicular to the first direction "X."

As shown in FIG. 4, the leftmost roofing membrane 100 includes the adhesive only on middle portion 135, such that each of first edge portion 131, second edge portion 132, third edge portion 133, and fourth edge portion 134 are free of adhesive. The rightmost roofing membrane 100 includes the adhesive on middle portion 135 and fourth edge portion 134, such that each of first edge portion 131, second edge portion 132, and third edge portion 133 are free of adhesive.

To connect the adjacent roofing membranes 100 to one another, one edge portion of one roofing membrane 100 which is free of the adhesive overlaps with one edge portion of the other roofing membrane 100 which is free of the adhesive, and the overlapping edges are welded to one another. As shown in FIG. 4, fourth edge portion 134 of the leftmost roofing membrane 100 and third edge portion 133 of the rightmost roofing membrane 100 overlap with one another, and the overlapping edge portions are welded to one another. By this arrangement, the edge portions that are free of the adhesive are welded to one another. In some embodiments, the adhesive on the first roofing membrane 100 does not contact the second roofing membrane 100, and the adhesive on the second roofing membrane 100 does not contact the first roofing membrane 100. However, in another embodiment, the adhesive on one roofing membrane may contact, at least to some extent, the other roofing membrane.

The arrangement shown in FIG. 4 may result when a length of roof deck 200 is greater than the length of one roofing membrane 100, but less than a combined length of two roofing membranes 100.

A patch or butt joint may be omitted between adjacent roofing membranes 100. More specifically, a patch or butt joint may be omitted between fourth edge portion 134 of leftmost roofing membrane 100, and third edge portion 133 of rightmost roofing membrane 100. This may reduce the time to install roofing membranes 100 on roof deck 200, and may omit obtaining a separate piece of roofing membrane to use as the patch.

Figure 5:
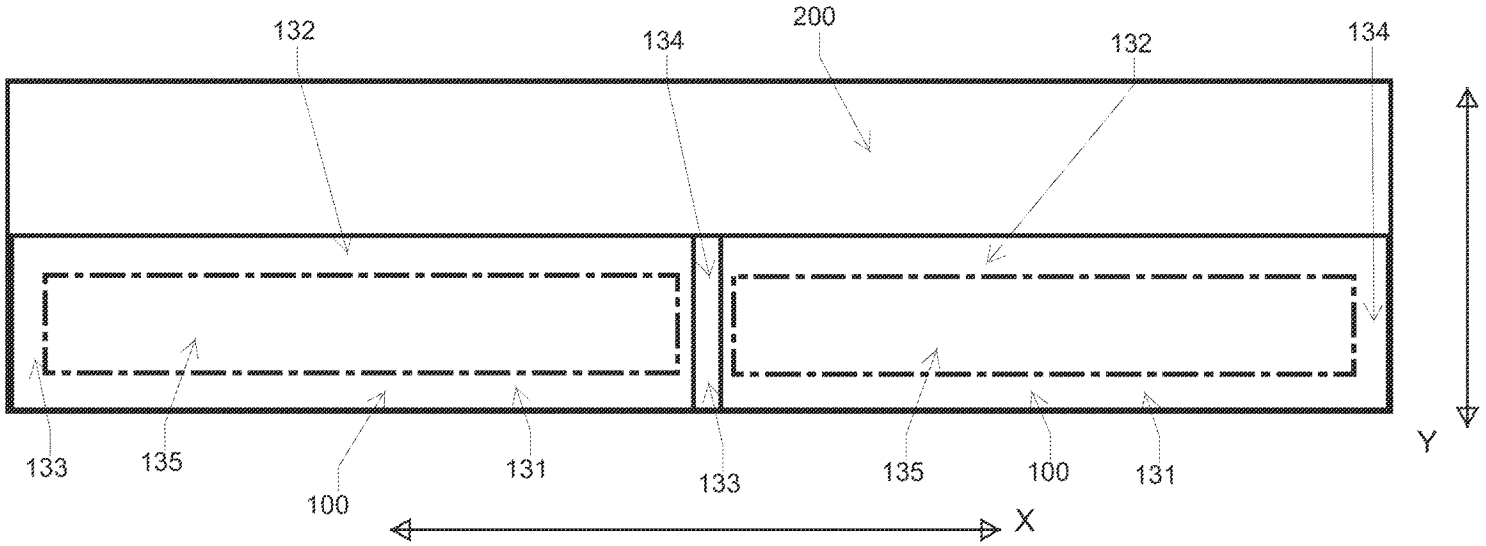
FIG. 5 is a top view of two roofing membranes installed on a roof deck, in accordance with another embodiment of the invention.

FIG. 5 shows a top view of two roofing membranes 100 attached to roof deck 200. Because FIG. 5 shows a top view, the figures shows the adhesive that is on the bottom of each roofing membrane 100 in dotted lines. Specifically, FIG. 5 shows an embodiment including two roofing membranes 100, each with four edge portions free of the adhesive, although the adhesive is disposed on the middle portion 135. That is, FIG. 5 shows two roofing membranes of FIGS. 2 and 3. The roofing membranes are disposed adjacent to one another, the length of each roofing membrane extending in a first direction "X," and the width of each roofing membrane extending in a second direction "Y" that is perpendicular to the first direction "X."

As shown in FIG. 5, each roofing membrane 100 includes the adhesive only on middle portion 135, such that each of first edge portion 131, second edge portion 132, third edge portion 133, and fourth edge portion 134 are free of the adhesive. As shown in FIG. 5, fourth edge portion 134 of the leftmost roofing membrane 100 and third edge portion 133 of the rightmost roofing membrane 100 overlap with one another, and the overlapping edge portions are welded to one another. By this arrangement, the edge portions that are free of the adhesive are welded to one another. In some embodiments, the adhesive on the first roofing membrane 100 does not contact the second roofing membrane 100, and the adhesive on the second roofing membrane 100 does not contact the first roofing membrane 100. However, in another embodiment, the adhesive on one roofing membrane may contact, at least to some extent, the other roofing membrane.

The arrangement shown in FIG. 5 may result when a length of roof deck 200 is equal to a combined length of two roofing membranes 100.

As discussed above with respect to FIG. 4, a patch or butt joint may be omitted between adjacent roofing membranes 100. More specifically, a patch or butt joint may be omitted between fourth edge portion 134 of leftmost roofing membrane 100, and third edge portion 133 of rightmost roofing membrane 100. This may reduce the time to install roofing membranes 100 on roof deck 200, and may omit obtaining a separate piece of roofing membrane to use as the patch.

Figure 6:
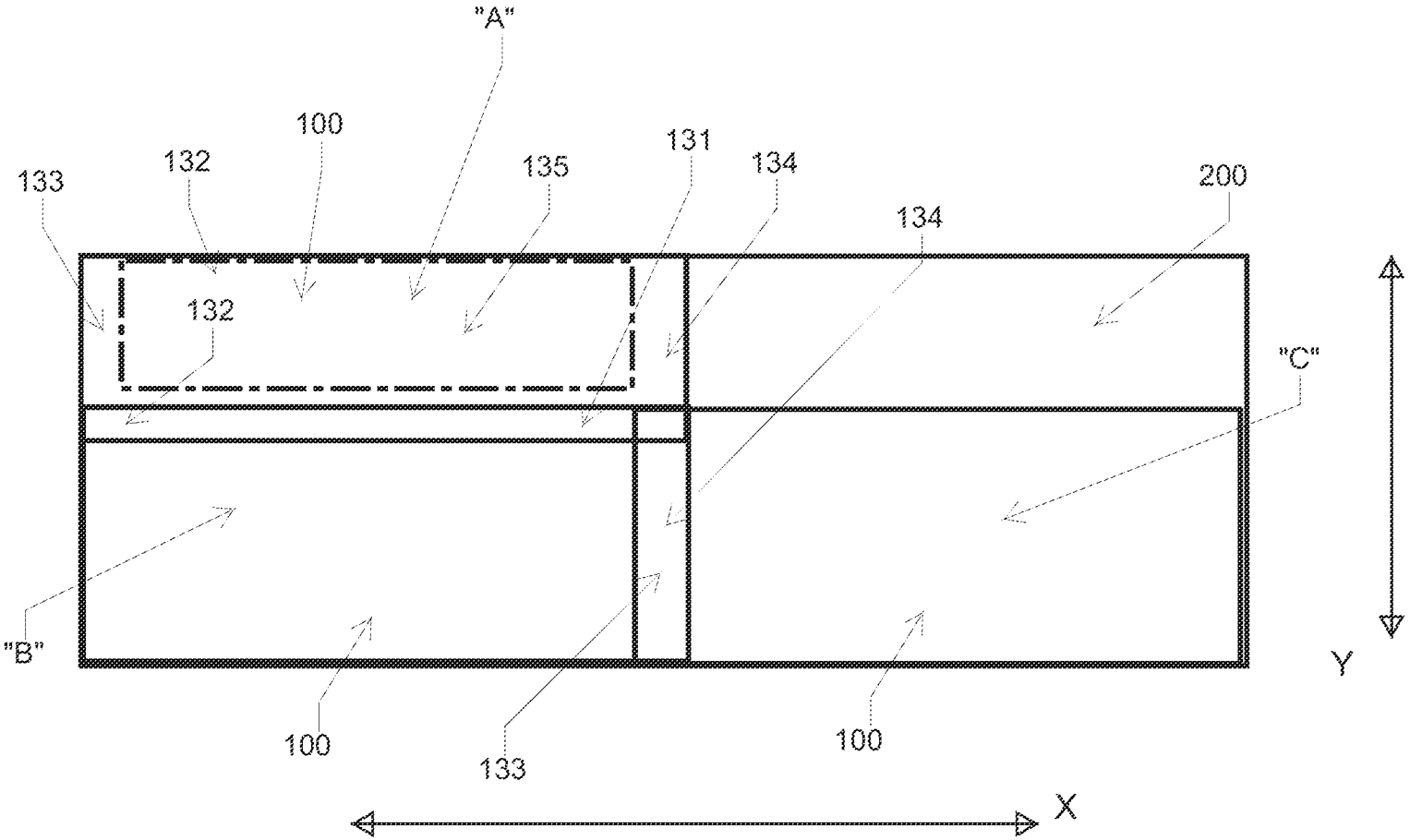
FIG. 6 is a top view of three roofing membranes installed on a roof deck, in accordance with another embodiment of the invention.

FIG. 6 shows a top view of three roofing membranes 100 attached to a roof deck 200. The two bottommost roofing membranes 100 may be one full-length roofing membrane and one partial-length roofing membrane as illustrated in FIG. 4, two full-length roofing membranes as illustrated in FIG. 5, or an arrangement in which each of the roofing membranes is a partial-length roofing membrane.

For clarity, the three roofing membranes 100 in FIG. 6 are designated as "A," "B," and "C." Because FIG. 6 is a top view, the adhesive of the topmost roofing membrane 100, designated as "A," is shown in dotted lines. For clarity, the adhesive of each of the bottommost roofing membranes 100, designated as "B" and "C," is not shown. Roofing membranes "B" and "C" are disposed adjacent to one another, such the length of each of these roofing membranes extends in a first direction "X," and the width of each of these roofing membranes extends in a second direction "Y" that is perpendicular to the first direction "X." Roofing membranes "A" and "B" disposed adjacent to one another in the second direction "Y."

The topmost roofing membrane "A" differs from other roofing membranes illustrated thus far inasmuch as topmost roofing membrane "A" is cut in a direction parallel to each of first edge portion 131 and second edge portion 132, and perpendicular to each of third edge portion 133 and fourth edge portion 134. Accordingly, the adhesive is disposed on middle portion 135 as well as on second edge portion 132. At least three edge portions may be free of the adhesive. Specifically, as shown in FIG. 6, each of first edge portion 131, third edge portion 133, and fourth edge portion 134, are free of the adhesive. In some embodiments, welds may be formed on overlapping edges that are free of the adhesive. In some embodiments, a weld may be formed between fourth edge portion 134 of roofing membrane "B" and third edge portion 133 of roofing membrane "C." In some embodiments, a weld may be formed between first edge portion 131 of roofing membrane "A," and second edge portion 132 of roofing membrane "B." In some embodiments, when another roofing membrane 100 is installed adjacent roofing membrane "A" and roofing membrane "C," welds may be formed between overlapping edges that are free of the adhesive—including a weld between fourth edge portion 134 of roofing membrane "A" and an edge portion free of the adhesive of the another roofing membrane, and including a weld between an edge portion free of the adhesive of the another roofing membrane and second edge portion of roofing membrane "C."

As discussed above, one or more patches or butt joints may be omitted between and/or among roofing membranes 100.

Roofing membranes with selvage edge portions that are free of the adhesive may allow the formation of welds between adjacent roofing membranes—more specifically, welds may be formed between overlapping, adhesive-free selvage edges of the adjacent roofing membranes. Thus, providing roofing membranes with at least three edge portions that are free of the adhesive may allow the formation of welds on at least three sides of the roofing membranes. Providing roofing membranes with four edge portions that are free of the adhesive may allow the formation of welds on all four sides of the roofing membranes. Forming welds, rather that forming butt joints between adjacent roofing membranes, may reduce the time to install the roofing membranes on a roof deck, and may omit obtaining separate pieces of roofing membrane to use as the patches.

It is to be understood that roofing membranes described throughout the description, and roofing membranes shown in the various figures, may be combined with each other, to cover a roof deck in various ways.

Variations, modifications and alterations to embodiments of the present disclosure described above will make themselves apparent to those skilled in the art. All such variations, modifications, alterations and the like are intended to fall within the spirit and scope of the present disclosure, limited solely by the appended claims.

While several embodiments of the present disclosure have been described, it is understood that these embodiments are illustrative only, and not restrictive, and that many modifications may become apparent to those of ordinary skill in the art. For example, all dimensions discussed herein are provided as examples only, and are intended to be illustrative and not restrictive.

Any feature or element that is positively identified in this description may also be specifically excluded as a feature or element of an embodiment of the present as defined in the claims.

The disclosure described herein may be practiced in the absence of any element or elements, limitation or limitations, which is not specifically disclosed herein. Thus, for example, in each instance herein, any of the terms "comprising," "consisting essentially of" and "consisting of" may be replaced with either of the other two terms, without altering their respective meanings as defined herein. The terms and expressions which have been employed are used as terms of description and not of limitation, and there is no intention in the use of such terms and expressions of excluding any equivalents of the features shown and described or portions thereof, but it is recognized that various modifications are possible within the scope of the disclosure.

The invention claimed is:

1. A roofing system comprising:

(a) a roof deck;

(b) a first membrane comprising:

a first sheet having:

a first top surface, and a first bottom surface opposite the first top surface, the first bottom surface having:

a first edge portion, a second edge portion opposite the first edge portion, a third edge portion extending between the first and second edge portions, a fourth edge portion opposite the third edge portion and extending between the first and second edge portions, and a middle portion disposed apart from the first, second, third, and fourth edge portions, a first adhesive disposed on the middle portion of the first bottom surface, wherein at least the first, second, and fourth edge portions of the first bottom surface are free of adhesive; and (c) a second membrane comprising:

a second sheet having:

a second top surface, and a second bottom surface opposite the second top surface, the second bottom surface having:

a first edge portion, a second edge portion opposite the first edge portion, a third edge portion extending between the first and second edge portions, a fourth edge portion opposite the third edge portion and extending between the first and second edge portions, and a middle portion disposed apart from the first, second, third, and fourth edge portions, a second adhesive disposed on the middle portion of the second bottom surface and at least one of the third edge portion or the fourth edge portion of the second bottom surface, and wherein at least the first and second edge portions of the second bottom surface are free of adhesive, wherein the first adhesive adheres the first membrane to the roof deck, wherein the second adhesive adheres the second membrane to the roof deck, wherein at least one of the third edge portion or the fourth edge portion of the second bottom surface overlaps with at least one of the third edge portion or the fourth edge portion of the first bottom surface, and wherein the at least one of the third edge portion or the fourth edge portion of the second bottom surface is welded or adhered via the second adhesive to the at least one of the third edge portion or the fourth edge portion of the first bottom surface.

2. The roofing system of claim 1, wherein the first edge portion of the first membrane extends in a first direction, wherein the first edge portion of the second membrane extends in the first direction, and wherein the first membrane is adjacent the second membrane.

3. The roofing system of claim 1, wherein the first adhesive does not contact the second membrane.

4. The roofing system of claim 1, wherein each of the first, second, third, and fourth edge portions of the first bottom surface are free of adhesive.

5. The roofing system of claim 4, wherein each of the first, second, and fourth edge portions of the second bottom surface are free of adhesive.

6. The roofing system of claim 1, wherein a width of at least one of the edge portions that is free of adhesive is from 2 to 6 inches.

7. The roofing system of claim 1, wherein a material of the first and second sheet is thermoplastic polyolefin (TPO).

8. The roofing system of claim 1, wherein at least one of the first membrane or the second membrane is from 50 to 100 feet in length and from 5 to 15 feet in width.

9. A method comprising:

(a) obtaining a first membrane comprising:

(i) a first sheet having:

a first top surface, and a first bottom surface opposite the first top surface, the first bottom surface having:

a first edge portion, a second edge portion opposite the first edge portion, a third edge portion extending between the first and second edge portions, a fourth edge portion opposite the third edge portion and extending between the first and second edge portions, and a middle portion disposed apart from the first, second, third, and fourth edge portions, (ii) a first adhesive disposed on the middle portion of the first bottom surface, wherein at least the first, second, and fourth edge portions of the first bottom surface are free of adhesive, and (iii) a first removable liner covering the first adhesive;

(b) removing the first removable liner from the first adhesive, to thereby expose the first adhesive;

(c) contacting the first adhesive of the first membrane to a roof deck, to thereby adhere the first membrane to the roof deck;

(d) obtaining a second membrane comprising:

(i) a second sheet having:

a second top surface, and a second bottom surface opposite the second top surface, the second bottom surface having:

a first edge portion, a second edge portion opposite the first edge portion, a third edge portion extending between the first and second edge portions, a fourth edge portion opposite the third edge portion and extending between the first and second edge portions, and a middle portion disposed apart from the first, second, third, and fourth edge portions, (ii) a second adhesive disposed on the middle portion of the second bottom surface and at least one of the third edge portion or the fourth edge portion of the second bottom surface, and wherein at least the first and second edge portions of the second bottom surface are free of adhesive, and (iii) a second removable liner covering the second adhesive;

(e) removing the second removable liner from the second adhesive, to thereby expose the second adhesive;

(f) contacting the second adhesive of the second membrane to the roof deck, to thereby adhere the second membrane to the roof deck, wherein at least one of the third edge portion or the fourth edge portion of the second bottom surface overlaps with at least one of the third edge portion or the fourth edge portion of the first bottom surface; and (g) welding or adhering via the second adhesive the at least one of the third edge portion or the fourth edge portion of the second bottom surface to the at least one of the third edge portion or the fourth edge portion of the first bottom surface.

10. The method of claim 9, wherein the first edge portion of the first membrane extends in a first direction, wherein the first edge portion of the second membrane extends in the first direction, and wherein the first membrane is adjacent the second membrane.

11. The method of claim 9, wherein the first adhesive does not contact the second membrane.

12. The method of claim 9, wherein each of the first, second, third, and fourth edge portions of the first bottom surface are free of adhesive.

13. The method of claim 12, wherein each of the first, second, and fourth edge portions of the second bottom surface are free of adhesive.

14. The method of claim 9, wherein a width of at least one of the edge portions that is free of adhesive is from 2 to 6 inches.

15. The method of claim 9, wherein a material of the first and second sheet is thermoplastic polyolefin (TPO).

16. The method of claim 9, wherein at least one of the first membrane or the second membrane is from 50 to 100 feet in length and from 5 to 15 feet in width.

17. The method of claim 9, further comprising:

obtaining a third membrane comprising:

a third sheet having:

a third top surface, and a third bottom surface opposite the third top surface, the third bottom surface having:

a first edge portion, a second edge portion opposite the first edge portion, a third edge portion extending between the first and second edge portions, a fourth edge portion opposite the third edge portion and extending between the first and second edge portions, and a middle portion disposed apart from the first, second, third, and fourth edge portions, a third adhesive disposed on the middle portion of the third bottom surface, wherein at least the first edge portion of the third bottom surface is free of adhesive, and a third removable liner covering the third adhesive;

removing the third removable liner from the third adhesive, to thereby expose the third adhesive;

contacting the third adhesive of the third membrane to the roof deck, to thereby adhere the third membrane to the roof deck, wherein the first edge portion of the third membrane and the second edge portion of the first membrane overlap one another; and welding the first edge portion of the third membrane and the second edge portion of the first membrane together.

18. The method according to claim 17, wherein at least three of the edge portions of the third bottom surface are free of adhesive.

19. A roofing system comprising:

(a) a roof deck;

(b) a first membrane comprising:

a first sheet having:

a first top surface, and a first bottom surface opposite the first top surface, the first bottom surface having:

a first edge portion, a second edge portion opposite the first edge portion, a third edge portion extending between the first and second edge portions, a fourth edge portion opposite the third edge portion and extending between the first and second edge portions, and a middle portion disposed apart from the first, second, third, and fourth edge portions, a first adhesive disposed on the middle portion of the first bottom surface, wherein at least the first, second, and fourth edge portions of the first bottom surface are free of adhesive; and (c) a second membrane comprising:

a second sheet having:

a second top surface, and a second bottom surface opposite the second top surface, the second bottom surface having:

a first edge portion, a second edge portion opposite the first edge portion, a third edge portion extending between the first and second edge portions, a fourth edge portion opposite the third edge portion and extending between the first and second edge portions, and a middle portion disposed apart from the first, second, third, and fourth edge portions, a second adhesive disposed on the middle portion of the second bottom surface and at least one of the first edge portion or the second edge portion of the second bottom surface, and wherein at least the third and fourth edge portions of the second bottom surface are free of adhesive, wherein the first adhesive adheres the first membrane to the roof deck, wherein the second adhesive adheres the second membrane to the roof deck, wherein at least one of the first edge portion or the second edge portion of the second bottom surface overlaps with at least one of the first edge portion or the second edge portion of the first bottom surface, and wherein the at least one of the first edge portion or the second edge portion of the second bottom surface is welded or adhered via the second adhesive to the at least one of the first edge portion or the second edge portion of the first bottom surface.

20. The roofing system of claim 19, wherein each of the first, second, third, and fourth edge portions of the first bottom surface are free of adhesive.

* * * * *